US006627048B1

(12) United States Patent
Shelnutt et al.

(10) Patent No.: US 6,627,048 B1
(45) Date of Patent: Sep. 30, 2003

(54) REDUCTIVE PRECIPITATION OF METALS PHOTOSENSITIZED BY TIN AND ANTIMONY PORPHYRINS

(75) Inventors: John A. Shelnutt, Tijeras, NM (US); Weiliang Gong, Albuquerque, NM (US); Abdesselam Abdelouas, Nantes (FR); Werner Lutze, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 179 days.

(21) Appl. No.: 09/846,593

(22) Filed: Apr. 30, 2001

(51) Int. Cl.[7] ..... C07C 1/00
(52) U.S. Cl. ..... 204/157.75; 204/157.4
(58) Field of Search ..... 204/157.4, 157.75

(56) References Cited

U.S. PATENT DOCUMENTS

| | | | |
|---|---|---|---|
| 4,568,435 A | 2/1986 | Shelnutt | 204/157.52 |
| 5,312,896 A | 5/1994 | Bhardwaj et al. | 528/353 |
| 6,107,480 A | 8/2000 | Funken et al. | 540/145 |

OTHER PUBLICATIONS

Shelnutt, J.A., "Photoreduction of methylviologen sensitized by dihydroxytin(IV) uroporphyrin," 1983, J. Amer. Chem. Soc., 105, 7179–7180, No month available.

Kalyanasundaram, K., Shelnutt, J.A., and Gratzel, M., "Sensitization and photoredox reactions of zinc(II) and antimony (V) uroporphyrins in aqueous media," 1988, Inorganic Chemistry, 27, 2820–2825, No month available.

Song, Z., Jia S., Miura, M., Ma, J., and Shelnutt, J.A., "Electron transfer photosensitized by a tin lipporphyrin in solution, micelles, and at water–organic solvent interfaces, "0 1988, J. Photochemistry and Photobiology A: Chemistry, 113, 233–241, No month available.

Yang et al., "In Situ Reduction of Metal Ions Photosensitized by Tin Protoporphyrin in Self–Assembled Silica Mesoporous Thin Films", Abstr. Pap.—Am. Chem. Soc., 221st, IEC–123. (no month available, 2001). Abstract only.*

* cited by examiner

*Primary Examiner*—Edna Wong
(74) *Attorney, Agent, or Firm*—Elmer A. Klavetter

(57) ABSTRACT

A method for reducing metals using a tin or antimony porphyrin by forming an aqueous solution of a tin or antimony porphyrin, an electron donor, such as ethylenediaminetetraaceticacid, triethylamine, triethanolamine, and sodium nitrite, and at least one metal compound selected from a uranium-containing compound, a mercury-containing compound, a copper-containing compound, a lead-containing compound, a gold-containing compound, a silver-containing compound, and a platinum-containing compound through irradiating the aqueous solution with light.

16 Claims, 2 Drawing Sheets

REDUCTIVE PRECIPITATION OF METALS PHOTOSENSITIZED BY TIN AND ANTIMONY PORPHYRINS

This invention was made with Government support under Contract No. DE-AC04-94AL85000 awarded by the Department of Energy. The Government has certain rights in the invention.

BACKGROUND OF THE INVENTION

The invention relates to a method for reducing metals and more particularly, to a method of reducing and precipitating a group of nanostructured metal materials by tin and antimony porphyrins.

A porphyrin is a cyclic tetrapyrrolic system consisting of a 20-carbon skeleton and has been used in a variety of electrical, optical, structural, and catalytic applications. Metal ions can covalently bond within the porphyrin structure. Various peripheral groups, both inorganic and organic, can be attached to the 20-carbon skeleton to provide desired physical, chemical, and optical characteristics.

Metalloporphyrin complexes exhibit a wide range of biological functions in proteins. For instance, the iron porphyrin (heme) in cytochrome $c_3$, a well studied protein found in iron-reducing bacteria (*Shewanella putrefaciens*) or sulfate-reducing bacteria (e.g., *Desulfovibrio vulgaris*) is likely involved in electron transport. Recently, it was recognized that cytochrome $C_3$ also catalyzes the non-biological reduction of metals such as U, Cr and Se.

Photoinduced redox reactions of a three-component system containing a photosensitizer, an electron donor, and an electron acceptor have been studied by several authors. Metallo-porphyrins are well-studied photosensitizers for the reduction of various acceptor molecules, usually methylviologen. For example, photoreduced tin porphyrins act as strong reductants in solution, in micelles, and at water-organic solvent interfaces, upon excitation by visible light and reduction by an electron donor such as a tertiary amine.

Shelnutt (Shelnutt, J., J. Amer. Chem. Soc., 1983, 105, 7179–7180; U.S. Pat. No. 4,568,435, issued on Feb. 4, 1986; both herein incorporated by reference) studied the ternary system comprised of Sn(IV) protoporphyrin IX (SnPP), TEA, and methylviologen ($MV^{2+}$), where SnPP is the photosensitizer, TEA is the electron donor, and $MV^{2+}$ is the electron acceptor. The photoinduced oxidation-reduction reaction is illustrated in FIG. 1. Irradiation of SnPP by visible light leads to excitation of the porphyrin to its lowest-lying triplet π—π state (SnPP*). Because the redox potential of the couple SnPP*/SnPP (+1.1 V) is higher than that of $TEA/TEA_{ox}$ (+0.82 V), excited SnPP* accepts an electron from TEA resulting in the radical porphyrin anion (FIG. 1). The low redox potential of the $SnPP^-$/SnPP couple (−0.66 V) allows the reduction of $MV^{2+}$ to $MV^+$ ($MV^{2+}/MV^+$; −0.45 V).[11] The quantum yield for the reaction is near 0.8. This photochemical cycle is reductive, a feature that is to-date unique to Sn(IV) and Sb(V) porphyrins. What makes the cycle reductive is that reduction of the porphyrin, rather than oxidation, is the initial step following photoexcitation. Several metalloporphyrins such as Zn porphyrins are known to follow an oxidative cycle.

DETAILED DESCRIPTION OF THE INVENTION

In the method of the present invention, a tin porphyrin (SnP) or antimony porphyrin (SbP) is used to reduce metal ions in a photoinduced reduction-oxidation (redox) reaction, where the metals include uranium (U), mercury (Hg), copper (Cu), lead (Pb), gold (Au), silver (Ag), and platinum (Pt). The metal ions that can be reduced depend on the redox potential. The potential can be controlled by suitable selection of the porphyrin's substituents, particularly by electron-withdrawing/donating substituents. Au, Ag and Pt are precious metals commonly used in microelectronic fabrication, and the method of the present invention can be utilized in nanoscale materials processing. Metals such as U, Hg, Cu and Pb are common contaminants in wastewater and groundwater and the method of the present invention can be utilized to remediate contaminated waters and in metal refining.

Figure 1:
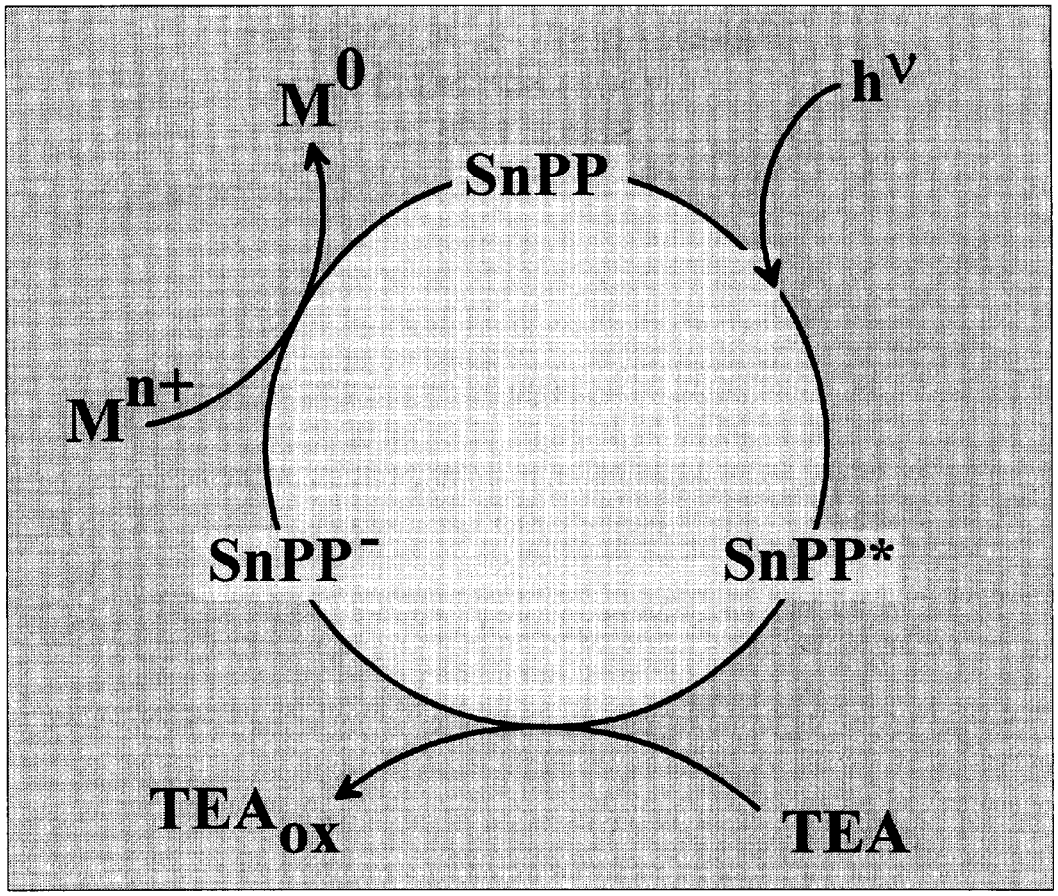
FIG. 1 shows an illustration of the tin porphyrin mediated photocycle for the reduction of metal salts.
Figure 2:
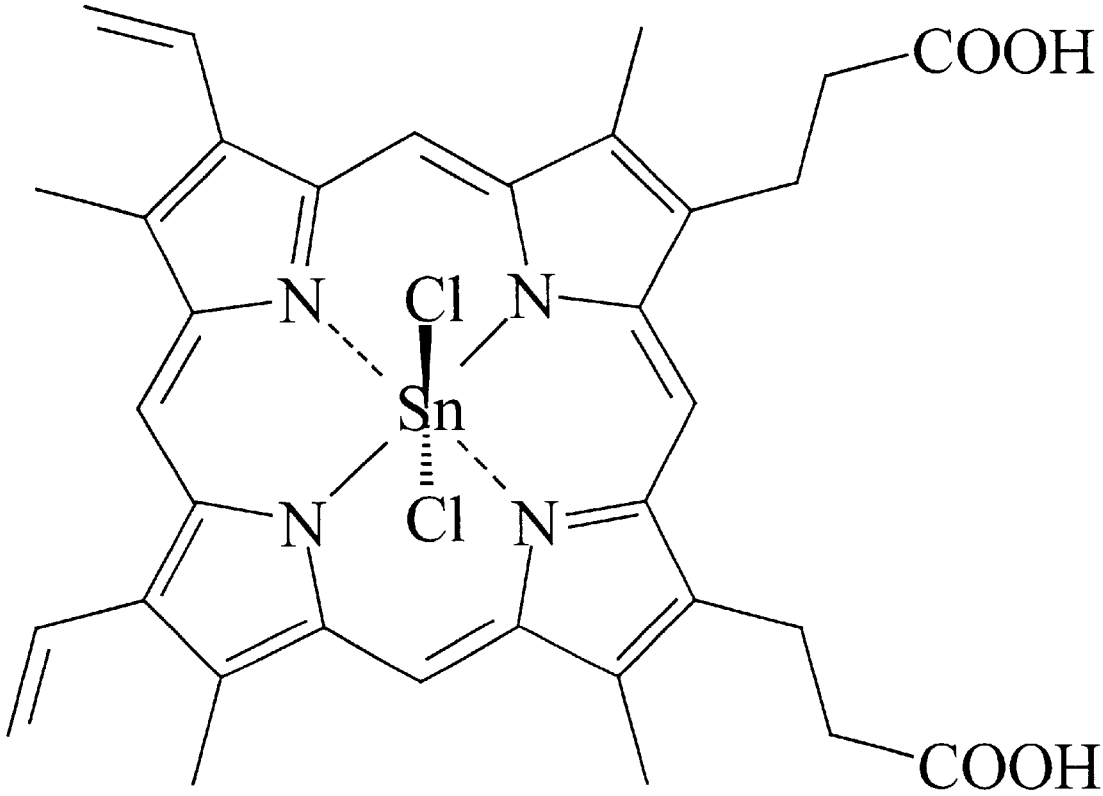
FIG. 2 shows an illustration of the structure of a tin porphyrin compound.

In one embodiment, a tin or antimony porphyrin, such as illustrated in FIG. 2, in the presence of an electron donor, such as ethylenediaminetetraaceticacid (EDTA), triethylamine, sodium nitrite, or triethanolamine (TEA), is exposed to a solution containing at least one metal selected from uranium, mercury, copper, lead, silver, gold and platinum. The solution is irradiated, such as by sunlight or an artificial light source, to reductively precipitate the metal. The time to precipitate the metal depends on the porphyrin and the metal and can range from minutes to days.

Typical reduction reactions of the metals are listed in Equations (1) to (7), where the metals are in typically-encountered compounds, such as nitrates and halides. Similar redox reactions would occur with the metals encountered as metal salts and like compounds.

$$2SnPP^- + UO_2(NO_3)_2.6H_2O = 2SnPP + UO_2 + 2NO_3^- + 6H_2O \quad (1)$$

$$2SnPP^- + HgCl_2 = 2SnPP + Hg^0 + 2Cl^- \quad (2)$$

$$2SnPP^- + CuCl_2.2H_2O = 2SnPP + Cu^0 + 2Cl^- + 2H_2O \quad (3)$$

$$2SnPP^- + Pb(NO_3)_2 = 2SnPP + Pb^0 + 2NO_3^- \quad (4)$$

$$2SnPP^- + Ag(NO_3)_2 = 2SnPP + Ag^0 + 2NO_3^- \quad (5)$$

$$3SnPP^- + HAuCl_4.xH_2O = 3SnPP + Au^0 + 4Cl^- + H^+ + xH_2O \quad (6)$$

$$4SnPP^- + H_2PtCl_6.6H_2O = 4SnPP + Pt^0 + 6Cl^- + 2H^+ + 6H_2O \quad (7)$$

The solubility of uraninite ($2\times10^{-8}$ M), $Hg^0$ ($10^{-29}$ M), $Cu^0$ ($10^{-44}$ M) and $Pb^0$ ($10^{-60}$ M) in water at 25° C. is very low. Therefore, their precipitation mediated by the tin protoporphyrin could be used to clean up contaminated waters. Following precipitation, these metal phases may be filtered for reuse or disposed of. Using SnPP for water remediation can be an efficient technique because it uses sunlight as the source of energy and an inexpensive electron donor, such as sodium nitrite or TEA.

Precipitation of precious metals photosensitized by SnP can be a practical way to extract and concentrate them from oxidizing waters. Furthermore, in the case of Au and Ag, formation of nanoparticles can find application in a variety of fields due to their optical, electrical, and catalytic properties. Growth of nanostructures such as nanowires and nano-networks can also be accomplished using the SnP photocycle to regenerate the SnP radical anion as shown in the reactions described by Equations (1)–(7).

The photoinduced reactions of the present invention can be induced by sunlight as the source of energy, lamps (such as a tungsten lamp) or any other energy source that produces light with wavelengths of 600 to 300 nm or even shorter or longer wavelengths, depending on the specific porphyrin used.

EXAMPLES

Stock 10-mM solutions of each of the metals were prepared by dissolving their respective salts in deionized water. In aqueous solution, $Sn(IV)Cl_2$ protoporphyrin (SnPP) or $Sn(IV)Cl_2$ tetra(N-methylpyridinium)porphyrin (SnTNMPP) exists as the dihydroxyl complex following replacement of the chloride ligands in aqueous solution.

For each experiment, the final concentration of the different components were: [metal]=$10^{-2}$ M; [SnP]=$10^{-6}$ M; [TEA]=$4\times10^{-1}$ M (or [EDTA]or [$NaNO_2$]=$8\times10^{-2}$ M). Control experiments using the SnPP were performed with methylviologen ($MV^{2+}$) as the electron acceptors; these showed that the reduction reaction, as demonstrated by the blue color of $MV^{+}$, can occur under exposure to sunlight, although the reactions were faster under an intense artificial tungsten light. Oxygenation of the solution led to the re-oxidation of $MV^{+}$ to $MV^{2+}$ although it did not affect the stability of SnPP. In fact, following oxygenation, evidenced by the loss of blue color due to oxidation of $MV^{+}$ to $MV^{2+}$, the oxidation of reduced $MV^{2+}$ by $O_2$ occurred and this reduction/oxidation cycle was repeated several times. Precipitation of metals was very fast (a few minutes) for certain metals (Ag, Hg), but took from a few hours to a few days for a noticeable precipitate to form for the rest of metals.

To analyze the resulting reduced metal precipitate, a few drops of the metal suspension were deposited onto a carbon-coated grid and rinsed with de-ionized water to remove soluble salts. The grids were placed into a JEOL transmission electron microscope (TEM), equipped with an energy dispersive spectrometry (EDS) system. The microscope was operated at 200 keV. The precipitates were analyzed for chemical composition and morphology. Crystal structure information was obtained using selected area electron diffraction (SAED).

Example 1

Reduction of $UV^{VI}$

In the experiments with uranium, $UO_2(NO_3)_2.6H_2O$ was reduced by the SnPP and TEA in the presence of sunlight to give a black precipitate. The appearance of a black precipitate was correlated with the decrease in the intensity of the yellow color of uranyl ion. The particles remained in suspension for several days. TEM results showed U-rich particles along with their electron diffraction pattern. The particles were very small with an average diameter of 10 nm. The d-spacings (0.315, 0.274, 0.195, 0.164, 0.127 and 0.112 nm) of particles indicated that the particles were cubic uraninite ($UO_2$). EDS measurements showed the particles consisted of U and O.

Example 2

Reduction of $Hg^{II}$

In the experiment with Hg, $HgCl_2$ was catalytically reduced by SnPP using TEA as the electron donor in the presence of sunlight. The reaction yielded a gray precipitate that appeared after only a few minutes and deposited onto the bottom of the vial within the hour. The TEM image showed that the Hg-rich particles exhibit a spherical shape. The particles evaporated under the electron beam, a characteristic of liquid mercury. EDS measurements confirmed the presence of $Hg^0$.

Example 3

Reduction of $Cu^{II}$ $CuCl_2.2H_2O$ was reduced in by SnPP and TEA in the presence of sunlight, producing in several days a reddish coating on the glass wall of the vial in which the reaction occurred. TEM results with Cu showed the morphology of the Cu-rich particles and indicated that the Cu particles had an average diameter of few microns and were aggregates of small particles (100 nm in diameter). These particles were pure Cu with traces of oxygen, which could indicate a slight oxidation of the surface of Cu. Attempts to obtain SAED data failed because the particles were too thick for the electron beam to penetrate. However, the red color of the precipitate, together with their composition, suggests the particles are $Cu^0$.

Example 4

Reduction of $Pb^{II}$ $Pb(NO_3)_2$ was reduced by the SnPP and TEA in the presence of sunlight. In the experiment with Pb, it took several days for a gray coating to appear on the glass wall. TEM showed that the particles were well-crystallized and the measured d-spacings (0.288, 0.250, 0.176, 0.150, 0.124, 0.114 and 0.102 nm) match those of cubic $Pb^0$. EDS measurements showed the particles consisted of Pb.

Example 4

Reduction of $Ag^{II}$

Colloidal suspension of Ag-rich particles was obtained only a few minutes after the beginning of the reaction where $Ag(NO_3)_2$ and EDTA in aqueous solution was exposed to the SnTNMPP in the presence of sunlight. A thin silver film also formed on the glass wall. The average size of these spherical particles was about 20 nm in diameter. SAED data (0.280, 0.235, 0.200, 0.141, 0.119, 0.0985, 0.083 and 0.077 nm) match those of cubic $Ag^0$, and EDS measurements showed the presence of Ag. Oxygen was not detected in agreement with the high stability of Ag in aqueous solutions. When $NaNO_2$ was used as the electron donor and the pH of the growth medium was adjusted to 1.5, 10–20-nm diameter nanowires of up to 1 $\mu$m in length were obtained.

Example 5

Reduction of $Au^{III}$ $HAuCl_4.xH_2O$ was reduced by the SnTNMPP and $NaNO_2$ in the presence of sunlight. The solution pH was adjusted to 1.5 by addition of $HNO_3$. A TEM image of the suspension showed that most particles were spherical aggregates of particles with an average size of about 20 nm in diameter. The measured d-spacings (0.220, 0.189, 0.132, 0.113, 0.109, 0.0967 and 0.085 nm) are similar to those of cubic $Au^0$, and EDS analysis shows the presence of pure Au.

Example 6

Reduction of $Pt^{II}$ $H_2PtCl_6.6H_2O$ was reduced by the SnPP and TEA in the presence of sunlight, giving a black precipitate that appeared after a few days and that deposited onto the bottom of the vial. The particles consisted of rods with several microns in length and 300 nm in diameter. EDS measurements showed the particles consisted of Pt.

The method of the present invention demonstrates that redox-sensitive metals, which are highly soluble in the oxidized state, can be reduced and precipitated from aqueous solution using tin protoporphyrin and light in the presence of an electron donor. $Hg^{2+}$, $Cu^{2+}$ and $Pb^{2+}$ were reduced to the metallic state, and $U^{6+}$ precipitated as oxide with very low solubility, indicating that removal of these metals via reductive photoreduction and precipitation can be used for wastewater treatment.

Important applications of the process are in the fabrication nanostructured metals and semiconductors. Especially interesting in this regard is the reduction of $Ag^{2+}$ and $Au^{3+}$ to the metallic state as nanoparticles or nanowires.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method for reducing metals, comprising the steps of:

forming an aqueous solution comprising a metal porphyrin, said metal porphyrin selected from the group consisting of tin porphyrin and antimony porphyrin, an electron donor, and at least one metal compound, wherein said at least one metal compound is selected from the group consisting of a uranium-containing compound, a mercury-containing compound, a copper-containing compound, a lead-containing compound, a gold-containing compound, a silver-containing compound, and a platinum-containing compound; and irradiating said aqueous solution with light to reduce said at least one metal compound.

2. The method of claim 1 wherein irradiating said aqueous solution with light results in a metal precipitate.

3. The method of claim 2 wherein the metal precipitate comprises uranium-containing particles with a diameter of approximately 10 nm.

4. The method of claim 2 wherein the metal precipitate comprises metallic mercury and the metal precipitate is formed within less than 10 minutes.

5. The method of claim 2 wherein the metal precipitate comprises metallic copper.

6. The method of claim 2 wherein the metal precipitate comprises metallic lead.

7. The method of claim 2 wherein the metal precipitate comprises metallic silver.

8. The method of claim 7 wherein the metallic silver is formed as spherical particles with an average diameter of approximately 20 nm.

9.The method of claim 7 wherein the metallic silver is formed as crystallinewires with an average diameter of 10 nm and length up to over 1 $\mu$m.

10. The method of claim 1 wherein irradiating said aqueous solution with light occurs with light of wavelengths between approximately 300 and 600 nm.

11. The method of claim 2 wherein the metal precipitate comprises metallic gold.

12. The method of claim 11 wherein the metallic gold is formed as aggregates of particles with an average diameter less than approximately 20 nm.

13. The method of claim 1 wherein irradiating said aqueous solution with light occurs by sunlight.

14. The method of claim 1 wherein the electron donor is selected from the group consisting of ethylenediaminetetraaceticacid, triethylamine, triethanolamine, and sodium nitrite.

15. The method of claim 1 wherein an amine is added to said aqueous solution.

16. The method of claim 1 wherein the metal compound is present as a metal salt.

* * * * *